US011950629B2

(12) United States Patent
Doci et al.

(10) Patent No.: US 11,950,629 B2
(45) Date of Patent: Apr. 9, 2024

(54) VAPOUR GENERATING DEVICE AND LID

(71) Applicant: JT International S.A., Geneva (CH)

(72) Inventors: Giovanni Doci, Lucerne (CH); Layth Bouchuiguir, Bellevue (CH)

(73) Assignee: JT International S.A. (CH)

( * ) Notice: Subject to any disclaimer, the term of this patent is extended or adjusted under 35 U.S.C. 154(b) by 735 days.

(21) Appl. No.: 17/054,281

(22) PCT Filed: May 17, 2019

(86) PCT No.: PCT/EP2019/062846
§ 371 (c)(1),
(2) Date: Nov. 10, 2020

(87) PCT Pub. No.: WO2019/224120
PCT Pub. Date: Nov. 28, 2019

(65) Prior Publication Data

US 2021/0212363 A1 Jul. 15, 2021

(30) Foreign Application Priority Data

May 25, 2018 (EP) ..... 18174434
Dec. 27, 2018 (TW) ..... 107147308

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
None
See application file for complete search history.

(56) References Cited

U.S. PATENT DOCUMENTS 6,615,840 B1 * 9/2003 Fournier ..... A24D 1/02 131/365
9,872,520 B1 * 1/2018 Elson ..... A24F 40/40
2010/0313901 A1 * 12/2010 Fernando ..... B65D 85/1081 131/330
2015/0053217 A1 * 2/2015 Steingraber ..... A24F 40/50 131/329
2015/0321793 A1 11/2015 Oved et al.
2016/0037826 A1 * 2/2016 Hearn ..... A61M 15/06 222/402.1
2017/0232121 A1 8/2017 Chiu et al.
(Continued)

FOREIGN PATENT DOCUMENTS

CN 105209343 A 12/2015
CN 206423569 U 8/2017
CN 107125805 A 9/2017
(Continued)

OTHER PUBLICATIONS

International Search Report including Written Opinion for PCT/EP2019/062846 dated Jul. 30, 2019; 13 pages.

*Primary Examiner* — Tho D Ta
(74) *Attorney, Agent, or Firm* — Lerner David LLP

(57) ABSTRACT

A vapour generating device is provided with a vapour generating place and a cover defining a closable opening to the vapour generating place. The cover is biased toward a closed position, so that dust and particulate matter may not readily enter the vapour generating place, and openable to an open position when receiving a vapour generating rod.

15 Claims, 5 Drawing Sheets

(56) References Cited

U.S. PATENT DOCUMENTS

2019/0307173 A1 10/2019 Qiu

FOREIGN PATENT DOCUMENTS

| | | | |
|---|---|---|---|
| CN | 107377492 | A | 11/2017 |
| CN | 107752130 | A | 3/2018 |
| WO | 2014042574 | A1 | 3/2014 |
| WO | 2017194751 | A1 | 11/2017 |
| WO | 2018054793 | A1 | 3/2018 |

* cited by examiner

VAPOUR GENERATING DEVICE AND LID

CROSS-REFERENCE TO RELATED APPLICATIONS

The present application is a national phase entry under 35 U.S.C. § 371 of International Application No. PCT/EP2019/062846, filed May 17, 2019, published in English, which claims priority to European Application No. 18174434.3 filed May 25, 2018, Taiwanese Application No. 107147308 filed Dec. 27, 2018, and International Application No. PCT/EP2018/097074 filed Dec. 28, 2018, all of the disclosures of which are incorporated herein by reference.

BACKGROUND

In traditional cigarettes tobacco is burned and the smoke is inhaled. An alternative to traditional cigarettes are heat-not-burn devices. Heat-not-burn devices heat tobacco at a lower temperature for vaporisation or aerosolisation, rather than burning it.

Heating devices for vaporisation or aerosolisation of tobacco products are known in the art. Such devices typically include a heating chamber and heater. In operation, an operator inserts the tobacco product into the heating chamber. The tobacco product is then heated with an electronic heater to vaporise or aerosolise the constituents of the tobacco product for the operator to inhale. In some examples, the tobacco product may be stick shaped.

An issue faced by such heating devices is in keeping the device clean to prevent detrimental effects on the user experience.

SUMMARY OF INVENTION

According to an aspect the present invention provides a vapour generating device. The vapour generating device comprises a vapour generating place for receiving a vapour generating rod and a cover defining a closable opening to the vapour generating place; the cover being biased toward a closed position and openable from the closed position to an open position when receiving the vapour generating rod. In this way the vapour generating place is closed when a vapour generating rod is not inserted; this prevents dust and particulate matter from entering the vapour generating place. As the cover is biased to a closed position, when a vapour generating rod is inserted through the opening, the cover is urged against the vapour generating rod, thereby holding it in place. The closable opening is also advantageous as the user is not required to manually open and close the cover before and after inserting the vapour generating rod.

Another aspect of the present invention provides a vapour generating device comprising a vapour generating place for receiving a vapour generating rod, and a lid connectable to the vapour generating place, the lid comprising a closable opening to the vapour generating place, the closable opening being biased toward a closed position and openable from the closed position to an open position when receiving the vapour generating rod. In this way the vapour generating place is closed by the lid when a vapour generating rod is not inserted; this prevents dust and particulate matter from entering the vapour generating place. As the opening in the lid is biased to a closed position, when a vapour generating rod is inserted through the opening, the opening is urged against the vapour generating rod, thereby holding it in place. The closable opening is also advantageous as the user is not required to manually detach and reattach the lid before and after inserting the vapour generating rod.

Preferably the closable opening or cover is arranged to be urged against a vapour generating rod received in the vapour generating place when in the open position. In this way a vapour generating rod received in the vapour generating place can be held securely in place by the closable opening.

Preferably the closable opening or cover is arranged to be urged against a vapour generating rod received in the vapour generating place by elastic or resilient properties of the closable opening or cover.

Preferably the cover can be arranged to be urged against a vapour generating rod by the vapour generating device comprising a membrane made from a resiliently flexible material with the closable opening arranged through the flexible membrane in the form of one or more slits. In this example the cover can be arranged to be urged against a vapour generating rod received in the vapour generating place by the resiliently flexible properties of the membrane urging the closable opening to the closed position; when the vapour generating rod is in the vapour generating place the one or more slits cannot reach the closed position and the membrane is urged against the vapour generating rod.

Alternatively the cover can be arranged to be urged against a vapour generating rod by the cover being provided as a spring-loaded hinged cover; the spring-loaded hinged cover can be arranged to bias the cover toward a closed position and is openable when receiving a vapour generating rod by the vapour generating rod pressing against the cover such that it pivots about the hinge inwardly to the vapour generating place. In this example the cover can be arranged to be urged against a vapour generating rod received in the vapour generating place by the spring-loading of the hinge urging the cover to the closed position; when the vapour generating rod is in the vapour generating place the cover cannot reach the closed position and the cover is urged against the vapour generating rod. That is, the cover may close automatically due to the cover being biased to the closed position, and may be stopped from closing due to the presence of a vapour generating rod in the vapour generating place.

In another alternative the cover can be arranged to be urged against a vapour generating rod by the cover utilising an elastic rubber material. For example, the elastic rubber material can be arranged as a cover with one or more deformable slits arranged therethrough to function in a manner similar to the aforementioned membrane example, using a rubber cover in place of the membrane. In another example the elastic rubber material can be arranged in place of the spring in the aforementioned spring-loaded hinged cover example.

Preferably the vapour generating device further comprises a lid connectable to the vapour generating place, wherein the closable opening is arranged in the lid.

Preferably the lid comprises a flexible membrane, or the cover is a flexible membrane and the lid comprises the flexible membrane, the closable opening being through the flexible membrane. In this way the flexible membrane can deform from the closed position to the open position when pressure is applied by the vapour generating rod. When the vapour generating rod is removed from the opening the resilient nature of the flexible membrane can bias the opening back toward the closed position thereby preventing particulate matter entering the vapour generating place. The arrangement of the flexible membrane and the closable opening is advantageous as it is a simple structure and there is no need for extra components or a manual opening and closing of the lid before the insertion and after the removal of the vapour generating rod.

Preferably the flexible membrane is surrounded by a surrounding portion, and more preferably the surrounding portion is made from a robust material. In this way the robust surrounding portion can be used to securely fasten the lid to the body of the vapour generating device. The flexible membrane may be in the centre of the surrounding portion.

Preferably the flexible membrane is projected outwardly from the surrounding portion.

Preferably the closable opening includes at least one slit in the flexible membrane. In this way the at least one slit can deform due to pressure applied from the vapour generating rod; this allows for the vapour generating rod to be easily received through the flexible membrane. Due to the resilient nature of the flexible membrane deformed portions of the membrane adjacent to the slit(s) can be urged against the vapour generating rod thereby holding it securely in place.

Preferably the at least one slit extends radially from a point on the membrane. In this way a vapour generating rod with a circular cross section can be securely accommodated by the membrane.

Preferably the at least one slit is curved. This has been found to contribute to securely holding in place a vapour generating rod received through the flexible membrane.

Preferably there are two or more slits, and the two or more slits are the same length, the same shape, and/or arranged with an equal angle therebetween. These options have each been found to contribute to securely holding in place a vapour generating rod received through the flexible membrane.

Preferably the lid is removable from the vapour generating device. In this way the vapour generating place can be easily accessed for cleaning. A further advantage is provided in that the lid can be replaced, if required, without replacing the entire device.

According to another aspect the present invention provides a system comprising the vapour generating device comprising a vapour generating rod inserted through the closable opening. In this way the vapour generating rod can be received by the vapour generating place so that it may be heated, with the lid or cover closing the vapour generating place when the vapour generating rod is not inserted to prevent dust and particulate matter building up in the vapour generating place. This is also advantageous as the user is not required to manually detach and reattach the lid before and after inserting the vapour generating rod.

Preferably the vapour generating device further comprises a lid connectable to the vapour generating place, wherein the closable opening is arranged in the lid.

Preferably the cover is biased toward a closed position when the vapour generating rod is removed from the closable opening. In this way, when the vapour generating rod is removed from the closable opening, the cover is biased to the closed position without the user having to manually close a lid and without the need for any extra components to close the opening.

Preferably, in an example in which the cover is the flexible membrane, the flexible membrane biases the at least one slit toward a closed positon when the vapour generating rod is removed from the slit. In this way, when the vapour generating rod is removed from the at least one slit, the resilient nature of the flexible membrane can bias the slit to a closed position without the user having to manually close a lid and without the need for any extra components to close the opening or a lid.

Preferably the vapour generating place is of a length shorter than that of the vapour generating rod such that when the vapour generating rod is inserted through the closable opening, into the vapour generating place, a mouthpiece end of the vapour generating rod extends outward from the vapour generating place or heating cavity through the closable opening. In this way the vapour generating rod can be easily removed from the vapour generating device with the lid or opening closing in one action. This also allows for the user to access the mouthpiece of the vapour generating rod whilst it is in the vapour generating place.

Preferably the vapour generating rod is a smoking device such as a smoking article i.e. a tobacco rod or cigarette, or any other type of material suitable for vaporisation or aerosolisation for inhalation by a consumer.

The vapour generating rod may include a rod with a vaporisable substance (such as tobacco) wrapped in a wrapper, such as paper, in the shape of a rod. The vapour generating rod may have a filter such as an acetate filter at its end.

The vaporisable substance may be any suitable substance capable of forming a vapour. The substance may be a solid or semi-solid substance. The substance may comprise plant derived material and in particular, the substance may comprise tobacco. Typically, the vaporisable substance is a solid or semi-solid tobacco substance. Example types of vapour generating solids or semi-solids include powder, granules, pellets, shreds, strands, porous material, foam or sheets. The substance may be a tobacco foam; tobacco foam typically comprises a plurality of fine tobacco particles and can typically also comprise a volume of water and/or a moisture additive, such as a humectant. The tobacco foam may be porous, and may allow a flow of air or vapour through the foam. Preferably, the vaporisable substance may comprise an aerosol-former. Examples of aerosol-formers include polyhyrdric alcohols and mixtures thereof such as glycerine or propylene glycol. Typically, the vaporisable substance may comprise an aerosol-former content of between approximately 5% and approximately 50% on a dry weight basis. Preferably, the vaporisable substance may comprise an aerosol-former content of approximately 10-20% on a dry weight basis.

Preferably the vapour generating place can comprise a cavity arranged to receive a vapour generating rod, and to provide heat from a heater which can be arranged in the cavity to a received vapour generating rod for the vaporisation or aerosolisation of the vapour generating rod material, i.e. the vapour generating place can be a heating cavity.

The lid may be internally threaded arranged to connect with an external thread of the body of the vapour generating device, or the lid may be arranged to connect to the body of the vapour generating device by a bayonet connection or a push connection. In this way the lid can be removably connected to the body of the vapour generating device.

The lid may have a surrounding portion made from a robust material such as a hard plastic or metal.

The heater may be an induction-type heater such as a combination of an induction coil and susceptor, an element-type heater, an infra-red heater, a laser heater, or any other suitable means for heating a tobacco product. An ultrasonic vaporiser may be arranged in the cavity instead of, or in addition to, the heater.

The closable opening, or the cover defining the closable opening, may be biased toward a closed position and openable from the closed position to an open position when receiving the vapour generating rod by way of a lid or cover connected to the body by a spring-loaded hinge arranged to bias the lid or cover toward the closed position.

DETAILED DESCRIPTION

Figure 1A:
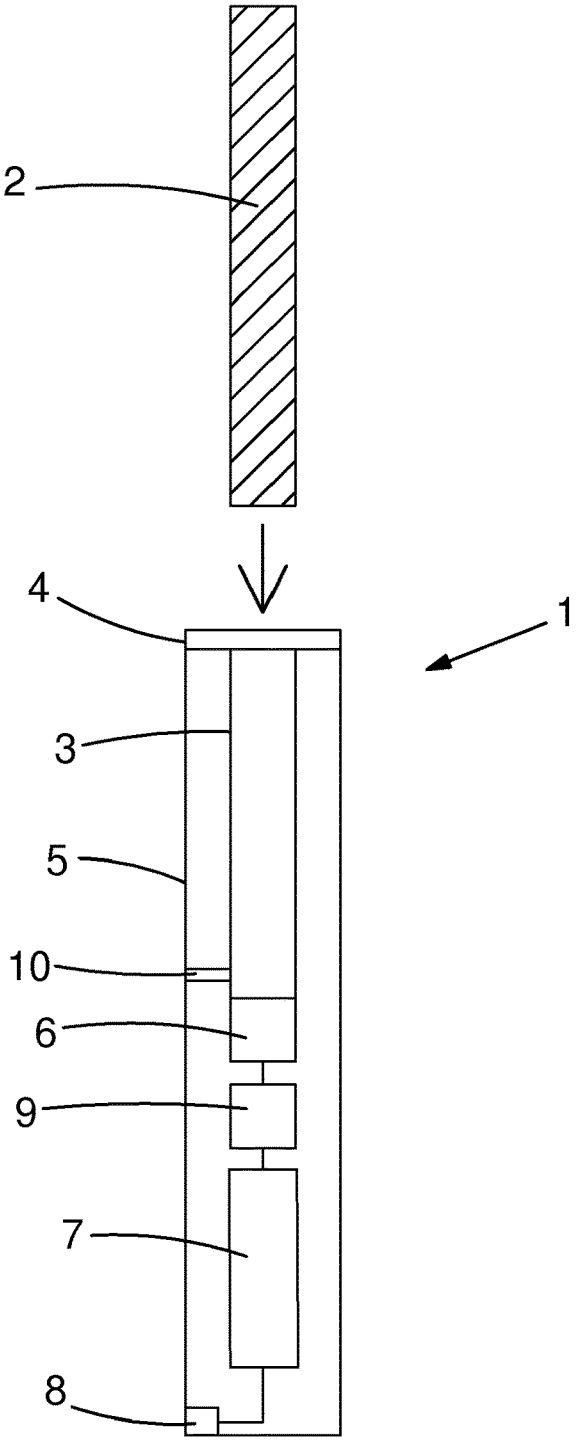
FIGS. 1A and 1B show diagrams of a vapour generating device according to a first embodiment of the invention.
Figure 1B:
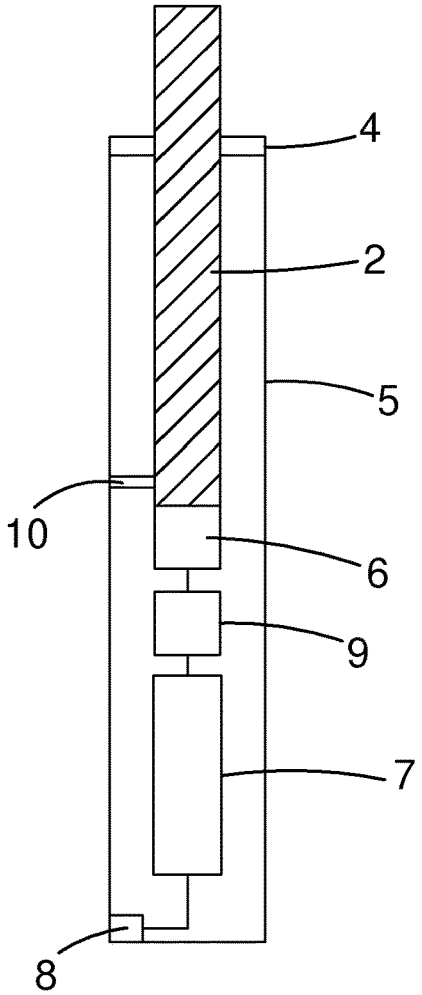

FIGS. 1A and 1B show a vapour generating device 1 according to a first embodiment of the invention. FIG. 1A shows the vapour generating device 1 separate to a vapour generating rod 2. FIG. 1B shows the vapour generating rod 2 received in the vapour generating device 1. The vapour generating device 1 comprises a vapour generating place or cavity 3 and a lid 4. The lid 4 is removably connected to the body 5 of the vapour generating device 1; in other embodiments the lid 4 may be affixed in a substantially permanent manner to the body 5. For the lid 4 to be removably connected to the body 5, the lid 4 has an internal thread arranged to connect with an external thread on the body 5; the lid 4 can then be removably attached to the body 5 with a screwing motion. In other embodiments, the lid 4 can be removably connected to the body 5 by way of a bayonet connection, a push connection, or any other means suitable for removable connection between the lid 4 and body 5. In embodiments where the lid 4 is affixed to the body 5 in a substantially permanent manner, the lid 4 can be affixed by a glue, studs, or any other suitable means. In other embodiments, the lid 4 and body 5 may be one continual piece of material rather than separable pieces.

The cavity 3 is arranged to receive a vapour generating rod 2 through a closable opening in the lid 4. The arrangement of the lid 4 is specifically described with reference to FIGS. 2 and 3A-C.

The vapour generating device 1 includes a heater 6 arranged to provide heat to the cavity 3. When a vapour generating rod 2 is positioned in the cavity 3, the heater 6 can be operated to heat the vapour generating rod 2. The heater 6 can be an element-type heater, an infra-red heater, a laser heater, or any other suitable means for heating a tobacco product. In other embodiments, an ultrasonic vaporiser is arranged in the cavity instead of, or in addition to, the heater.

As shown in FIG. 1B, the cavity 3 is dimensioned to be shorter in length than the vapour generating rod 2 so that when the vapour generating rod 2 is inserted through the closable opening in the lid 4 a mouthpiece end of the vapour generating rod extends outward from the cavity 3 through the closable opening; i.e. the vapour generating rod 2 is not pushed fully through the opening. This arrangement allows for the user to access the mouthpiece to draw on the vapour generating rod 2 when the vapour generating rod 2 is positioned in the cavity 3, and also to easily remove of the vapour generating rod 2 at the end of use.

In operation, the vapour generating rod 2 is inserted through the opening in the lid 4 and received in the cavity 3. The vapour generating rod 2 is heated by the heater 6 and the user may then draw on the heated vapour generating rod 2 to produce a vapour. The user may subsequently remove the spent vapour generating rod 2 through the opening in the lid 4 when the use is completed. The cavity 3 may have at least one air inlet 10, in addition to the closable opening, arranged to equalise the air pressure in the cavity 3 when the user draws on the vapour generating rod 2.

An internal power supply 7, such as a rechargeable battery, is arranged in the body 5 to provide power to the heater 6. An external power input 8 is arranged in connection with the internal power supply 7 so that the internal power supply 7 can be charged and recharged as required. The internal power supply 7 is connected to the heater 6 by way of a controller 9. The controller 9 can be arranged to provide power to heater 6 when instructed by a user input, for example by an operable button on the body 5. The controller 9 can also be arranged to automatically provide power to the heater 6 upon detection of a vapour generating rod 2 in the cavity 3.

Figure 2:
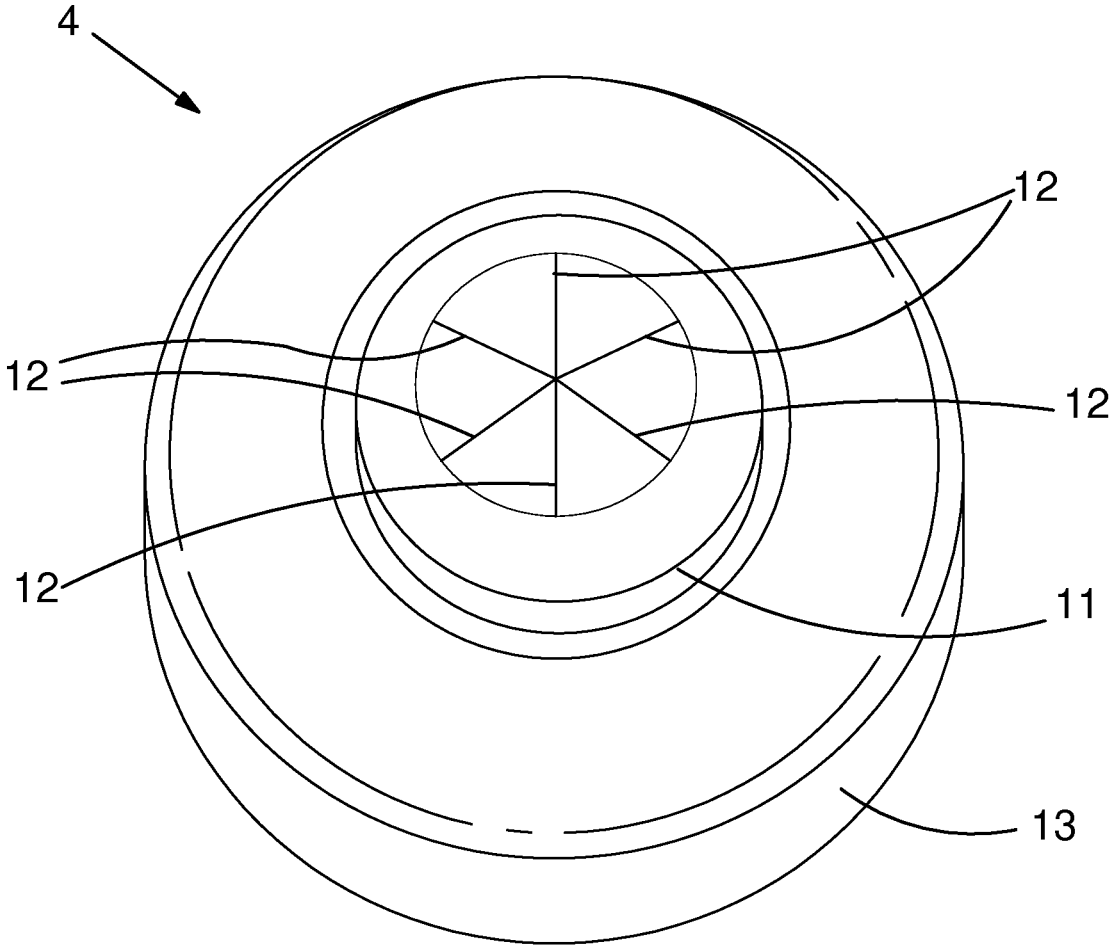
FIG. 2 shows a perspective view of a lid for a vapour generating device according to a first embodiment of the invention.

FIG. 2 shows a lid 4 for use with the vapour generating device 1 described with to FIG. 1. The lid 4 comprises membrane portion 11 and a surrounding portion 13. The surrounding portion 13 is substantially circular in cross-sectional shape, although in other embodiments the surrounding portion 13 may have a square or rectangular cross-sectional shape, or any other suitable cross-sectional shape. The surrounding portion 13 is made from a robust material such as a hard plastic or metal and comprises the internal thread for attachment to the body of the vapour generating device. The membrane portion 11 has substantially the same cross-sectional shape as the surrounding portion 13, only with a smaller cross-section such that the surrounding portion 13 surrounds the membrane portion 11. The membrane portion 11 is in the centre of the surrounding portion 13. In other embodiments the membrane portion 11 may be of a different cross-sectional shape to that of the surrounding portion 13; the membrane portion 11 may be positioned off-centre of the surrounding portion 13. The membrane 11 is projected outwardly from a top surface of the surrounding portion 13. In other embodiments the membrane 11 may be substantially planar to the top surface of the surrounding portion 13, or projected inwardly. The membrane portion 11 has substantially the same cross-sectional shape as that of a vapour generating rod to be received through the membrane 11. In other embodiments, the membrane portion 11 may have a different cross-sectional shape to that of a vapour generating rod.

In the example shown, the membrane 11 has six slits 12 extending radially from the centre of the membrane 11. The membrane 11 may have other numbers of slits 12 in order to operate in substantially the same manner. The slits 12 provide the closable opening. The membrane 11 is flexible in nature and the slits 12 are biased toward a closed position by the resilience of the flexible membrane 11. The membrane 11 may be made from rubber, a polymer, or any other suitably resiliently flexible material.

Figure 3A:
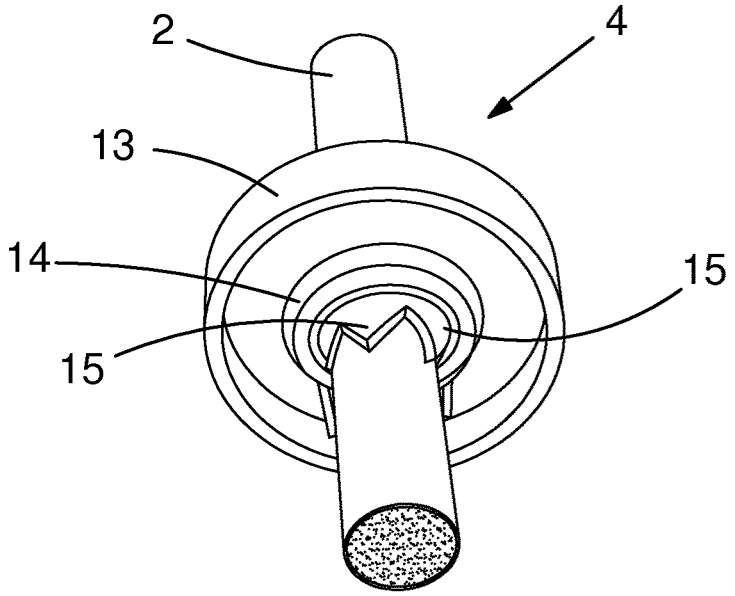
FIGS. 3A, 3B and 3C show perspective views a lid, for a vapour generating device according to the first embodiment of the invention, into which a vapour generating rod is inserted.
Figure 3B:
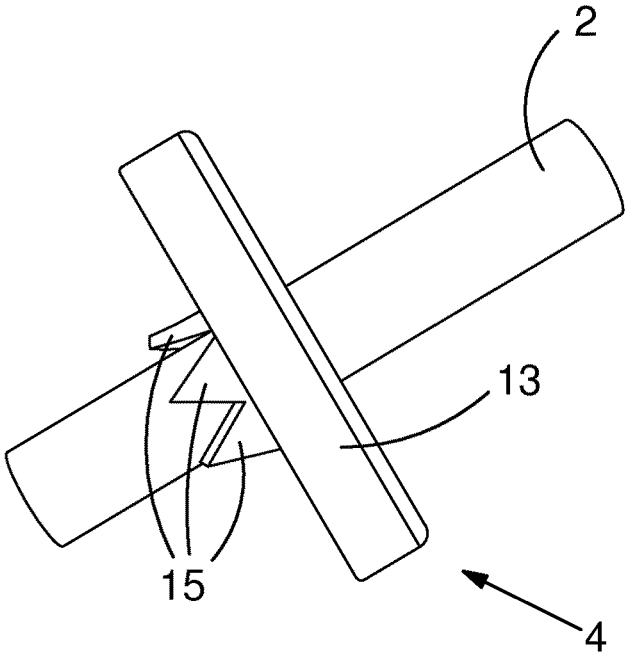
Figure 3C:
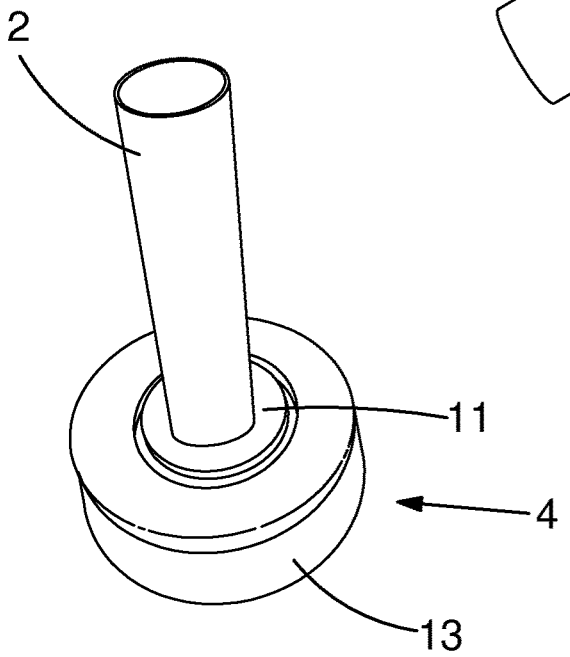

FIGS. 3A, 3B and 3C show multiple perspective angles of a lid 4 in which a vapour generating rod 2 has been received through the closable opening provided by the slits 12 in the membrane 11. The membrane 11 is fixed to the surrounding portion 13 of the lid 4 by a collar 14. In other embodiments, the membrane 11 may be glued, held in place with studs, or affixed in any other suitable manner.

When a vapour generating rod 2 is pushed against the slits 12, the slits 12 deform creating the closable opening through which the vapour generating rod 2 can pass. When passed through the slits 12, the resiliently flexible nature of the deformed portions 15 of the membrane 11 bias against the vapour generating rod 2 to hold it in position. This provides a seal around the vapour generating rod 2 so that it is securely held in position when in operation.

The vapour generating rod 2 is removed from the closable opening in the slits 12 by pulling it back through the slits 12 in the opposite direction to which it was pushed when inserting it. The resilient nature of the flexible membrane 11 consequently results in a biasing of the deformed portions 15 of the slits 12 back to the closed position (as shown in FIG. 2) thereby closing the closable opening. Advantageously, the lid 4 does not need to be opened or closed manually by the user when inserting and removing the vapour generating rod 2; the vapour generating rod 2 only needs to be pushed or pulled through the slits 12. This automatic closing of the closable opening, when the vapour generating rod 2 is removed, is beneficial as it prevents dust and particulate matter entering the cavity without the user having to manually close a lid.

Figure 4A:
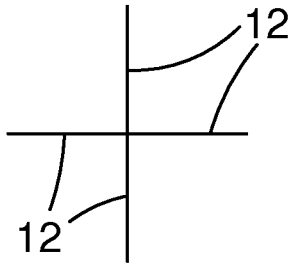
FIGS. 4A, 4B and 4C show diagrams of alternate slit arrangements for alternate embodiments.
Figure 4B:
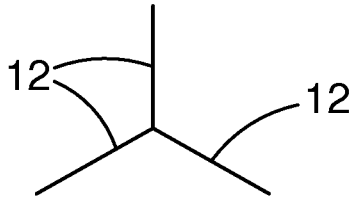
Figure 4C:
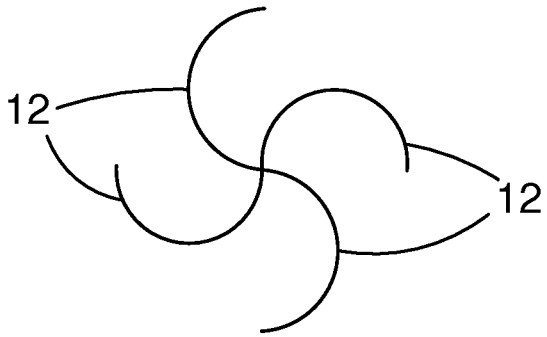

The number, shape and arrangement of slits 12 in the membrane is not limited to that described with reference to the first embodiment. Any number of slits 12, including one slit, can also be used without departing from the operation of the closable opening as described with reference to the first embodiment. By way of example, FIGS. 4A, 4B and 4C show other possible arrangements of slits 12 for use in a membrane. FIG. 4A shows a diagram of how four straight slits 12 may be arranged to radially extend from the centre of the membrane. FIG. 4B shows how three straight slits 12 may be arranged to radially extend from the centre of the membrane. FIG. 4C shows how four semi-circular curved slits may be arranged in the membrane. In some embodiments, each of the slits are substantially the same size and shape, and are arranged with a substantially equal angle between them. In other embodiments, the slits can be of different sizes and shapes, and have different angles between them.

Figure 5A:
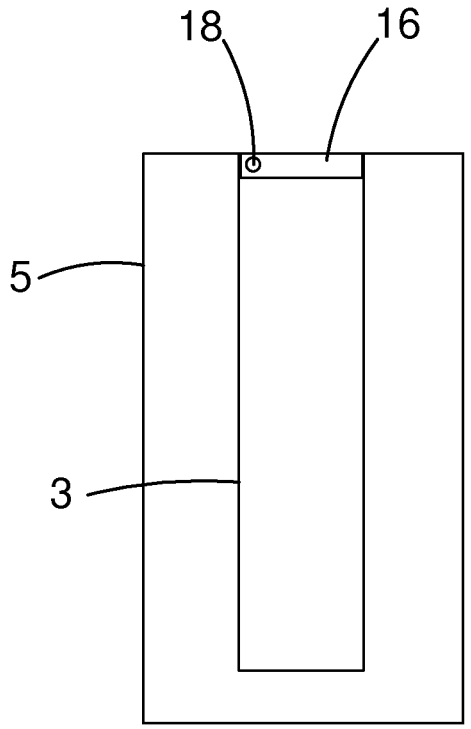
FIGS. 5A and 5B show diagrams of a vapour generating device according to an alternative embodiment of the invention.
Figure 5B:
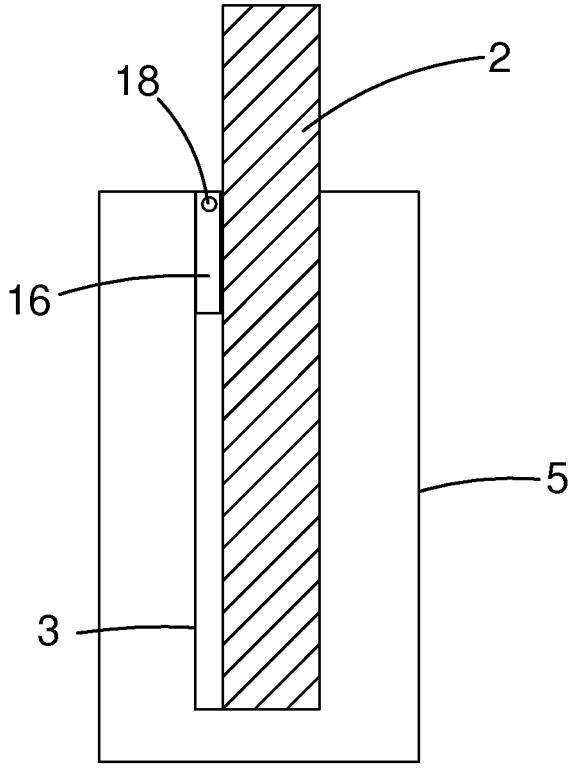

FIGS. 5A and 5B show an alternative embodiment of a vapour generating device, in which the closable opening is provided by a hinged lid, or cover, rather than slits in a flexible membrane. The vapour generating device has a body 5 in which a vapour generating place 3 is arranged. It is understood that the embodiment of FIG. 5 includes the features of FIG. 1, although they are not shown for visual ease. In the embodiment shown in FIG. 5, the lid or cover 16 is connected to the body 5 by a hinge 18, to provide a closable opening to the vapour generating place. The hinge 18 is a spring-loaded hinge, arranged to bias the lid or cover 16 toward a closed position, as shown in FIG. 5A. In FIG. 5B a vapour generating rod 2 has been received in the vapour generating place 3. When the vapour generating rod 2 is pushed against the lid or cover 16, the lid or cover 16 is displaced around the hinge 18. The spring-loaded hinge 18 urges the lid or cover 16 against the vapour generating rod 2 to hold it in position. The vapour generating rod 2 is removed from the vapour generating place by pulling it back through the closable opening; the spring-loaded hinge 18 then returns the lid or cover 16 to the closed position as shown in FIG. 5A. That is, the cover may close automatically due to the cover being biased to the closed position, and may be stopped from closing due to the presence of a vapour generating rod in the vapour generating place.

In an alternative, a lid may be connectable to the body of the device, by way of an internal thread arranged to connect with an external thread on the body. In such an alternative, the lid has hinged portion, or cover, connected to a surrounding portion by way of a spring-loaded hinge, wherein the hinged portion of the lid is biased toward a closed position by the spring-loaded hinge and operates in substantially the same manner as that described with reference to FIGS. 5A and 5B.

That is, the lid can have a hinged portion defining a cover for an opening through the lid, wherein the cover can be connected to the surrounding portion of the lid (the surrounding portion defining the opening through the lid) by the spring-loaded hinge. The cover can be biased toward the closed position by the spring-loaded hinge. The closable opening can be provided in the lid by the hinged cover and opening in the lid.

When a vapour generating rod is pushed against the cover, the cover is displaced around the hinge inward to the vapour generating place. The spring-loaded hinge urges the cover against the vapour generating rod when the vapour generating rod is in the vapour generating place to hold the vapour generating rod in position. The vapour generating rod is removed from the vapour generating place by pulling it back through the closable opening; the spring-loaded hinge then returns the cover to the closed position. That is, the cover may close the opening automatically due to the cover being biased to the closed position, and may be stopped from closing due to the presence of a vapour generating rod in the vapour generating place.

In further embodiments the closable opening may be provided by other means, such as closable aperture.

The described features and embodiments may be combined in any suitable arrangement without departing from the scope of the invention.

The invention claimed is:

1. A vapour generating device comprising;

a vapour generating place for receiving a vapour generating rod; and a cover defining a closable opening to the vapour generating place, the cover biased toward a closed position and openable from the closed position to an open position when receiving the vapour generating rod, wherein the cover is a flexible membrane and the closable opening is through the flexible membrane.

2. The device of claim 1, wherein the cover is arranged to be urged against a vapour generating rod received in the vapour generating place when in the open position.

3. The device of claim 1, further comprising a lid connectable to the vapour generating place, wherein the closable opening is arranged in the lid.

4. The device of claim 3, wherein the lid comprises the flexible membrane.

5. The device of claim 4, wherein the flexible membrane is surrounded by a surrounding portion.

6. The device of claim 5, wherein the surrounding portion is made from a robust material.

7. The device of claim 4, wherein the closable opening includes at least one slit in the flexible membrane.

8. The device of claim 7, wherein the at least one slit extends radially from a point on the membrane.

9. The device of claim 7, wherein the at least one slit is curved.

10. The device of claim 7, wherein there are two or more slits, and the two or more slits are:

the same length;

the same shape; and/or arranged with an equal angle therebetween.

11. The device of claim 3, wherein the lid is removable from the vapour generating device.

12. A system comprising the vapour generating device of claim 1, and a vapour generating rod inserted through the closable opening.

13. The system of claim 12, wherein the cover is biased toward a closed position when the vapour generating rod is removed from the closable opening.

14. The system of claim 12, wherein the vapour generating place is of a length shorter than that of the vapour generating rod such that when the vapour generating rod is inserted through the closable opening, into the vapour generating place, a mouthpiece end of the vapour generating rod extends outward from the vapour generating place through the closable opening.

15. The system of claim 12, wherein the vapour generating rod is a smoking device.

* * * * *